US007973268B2

(12) United States Patent
Miyauchi et al.

(10) Patent No.: US 7,973,268 B2
(45) Date of Patent: Jul. 5, 2011

(54) INDUCTION HEATING COOKING DEVICE

(75) Inventors: Takahiro Miyauchi, Hyogo (JP); Shinji Kondo, Osaka (JP)

(73) Assignee: Panasonic Corporation, Osaka (JP)

( * ) Notice: Subject to any disclaimer, the term of this patent is extended or adjusted under 35 U.S.C. 154(b) by 396 days.

(21) Appl. No.: 12/211,237

(22) Filed: Sep. 16, 2008

(65) Prior Publication Data

US 2009/0014440 A1 Jan. 15, 2009

Related U.S. Application Data

(62) Division of application No. 10/595,277, filed as application No. PCT/JP2004/016360 on Oct. 28, 2004, now Pat. No. 7,442,907.

(30) Foreign Application Priority Data

Oct. 30, 2003 (JP) ..... 2003-370393

(51) Int. Cl.
*H05B 6/06* (2006.01)
*H05B 6/12* (2006.01)

(52) U.S. Cl. ..... 219/661; 219/662; 219/663

(58) Field of Classification Search ..... 219/661–665, 219/660, 626, 619, 674, 667, 620; 399/67, 399/69, 88, 328–332, 334; 363/37, 67, 80, 363/97

See application file for complete search history.

(56) References Cited

U.S. PATENT DOCUMENTS 6,246,843 B1 * 6/2001 Nanataki et al. ..... 399/45
7,015,438 B2 3/2006 Hirota et al.

FOREIGN PATENT DOCUMENTS

| | | |
|---|---|---|
| EP | 0 460 279 | 12/1991 |
| GB | 2 108 786 | 5/1983 |
| JP | 10-336805 | 12/1998 |
| JP | 11-260542 | 9/1999 |
| JP | 11-260542 A | 9/1999 |
| JP | 2002-75620 | 3/2002 |
| JP | 2002-170657 | 6/2002 |
| JP | 2003-151748 | 5/2003 |

OTHER PUBLICATIONS

Supplementary European Report issued May 8, 2009 in the a counterpart European application.

K. Izaki et al., "New Constant-Frequency Variable Powered Quasiresonant Inverter Topology Using Soft-Switched Type IGBTS for Induction-Heated Cooking Appliance with Active Power Filter," EPE '95: 6th European conference on Power Electronics and Applications. Sevilla. Sep. 19-21, 1995, Brussels, EPE Assoc. B, vol. 2, Sep. 19, 1995, pp. 2.129-2.134.

International Search Report issued Jan. 25, 2005 in the International (PCT) Application of which the parent of the present application is the U.S. National Stage.

* cited by examiner

*Primary Examiner* — Quang T Van

(74) *Attorney, Agent, or Firm* — Wenderoth, Lind & Ponack, L.L.P.

(57) ABSTRACT

An induction heating cooking device has an inverter including a resonant circuit, and a heating output control part. The resonant circuit has a resonant capacitor and a heating coil that is magnetically coupled to a load. The inverter has first and second switching elements. The heating output control part performs control by inverting the rate values of the driving periods of the first and second switching elements. The driving of the inverter is thus controlled so that substantially the same heating output is obtained to average the losses of the first and second switching elements.

5 Claims, 6 Drawing Sheets

INDUCTION HEATING COOKING DEVICE

This application is a divisional application of U.S. Ser. No. 10/595,277 now U.S. Pat. No. 7,442,907, which is the U.S. National Phase of International Application PCT/JP2004/016360, filed Oct. 28, 2004.

TECHNICAL FIELD

The present invention relates to an induction heating cooking device that has a resonant circuit and induction-heats a load especially made of nonmagnetic metal with low resistivity.

BACKGROUND ART

A conventional induction heating cooking device that induction-heats a load made of nonmagnetic metal with low resistivity, is disclosed in Japanese Patent Unexamined Publication No. 2002-75620, for example.

FIG. 7 is a circuit diagram of the conventional induction heating cooking device. In FIG. 7, power supply 21 is a 200 V commercial power supply, namely a low frequency alternating-current power supply, and is connected to an input terminal of rectifying circuit 22 with a bridge diode. First smoothing capacitor (hereinafter referred to as "capacitor") 23 is connected between the output terminals of rectifying circuit 22. A series connection body of chock coil 24 and second switching element (insulated gate bipolar transistor (IGBT)) (hereinafter referred to as "element") 27 is also connected between the output terminals of rectifying circuit 22. Heating coil 29 faces load 31 such as an aluminum-made pan.

The low-potential-side terminal (emitter) of second smoothing capacitor (hereinafter referred to as "capacitor") 32 is connected to a negative electrode terminal of rectifying circuit 22. The high-potential-side terminal of capacitor 32 is connected to the high-potential-side terminal (collector) of first switching element (IGBT) (hereinafter referred to as "element") 25. The low-potential-side terminal of element 25 is connected to a connection point between the high-potential-side terminal (collector) of element 27 and chock coil 24. The series resonant circuit of heating coil 29 and resonant capacitor 30 is connected to element 27 in parallel.

First diode (hereinafter referred to as "diode") 26 (first inverse conducting element) is connected to element 25 in anti-parallel. The cathode of diode 26 is connected to the collector of element 25. Second diode (hereinafter referred to as "diode") 28 (second inverse conducting element) is connected to element 27 in anti-parallel. Namely, the cathode of diode 28 is connected to the collector of element 27. Controlling means 33 outputs signals to gates of elements 25 and 27 so as to produce a predetermined output.

In the induction heating cooking device having this constitution, the frequency of resonance current is set twice or more as high as the driving frequency of elements 25 and 27. Chock coil 24 increases the voltage of smoothing capacitor 32, so that a nonmagnetic load with low resistivity such as aluminum is induction-heated with a high output power.

When the resonance frequency is set substantially 2N (where, N is a positive integer) times higher than the driving frequency of switching elements in the conventional configuration, however, switching element driving duty defined by rates of the driving periods of element 25 and element 27 for maximizing the heating output is not 0.5. The on-state loss of each of switching elements 25 and 27 depends on each on-state period, so that imbalance between the losses occurs.

Thus, especially when the heating output is large, it is difficult to cool the switching elements.

SUMMARY OF THE INVENTION

An induction heating cooking device of the present invention has an inverter including a resonant circuit, and a heating output control part. The resonant circuit has a resonant capacitor and a heating coil that is magnetically coupled to a load. The inverter has a series circuit of a first switching element and a second switching element, and supplies electric power to the resonant circuit. The heating output control part sets the driving frequency of the first and second switching elements to be substantially 1/n (where, n is an integer of 2 or more) times higher than the resonance frequency of the resonant circuit in heating the load. Driving duty, defined by respective rates of the driving period of the first switching element and the driving period of the second switching element, is repeatedly switched between a first driving duty and a second driving duty different from the first driving duty, and controlled. The second driving duty is a driving duty at which the lengths of the driving period of the first switching element and the driving period of the second switching element are inverted with respect to the first driving duty, and substantially the same heating coil current and heating output are obtained before and after the switching between the driving duties. Thanks to this configuration, the losses of the switching elements are equalized, the switching elements are easily cooled, and a large heating output is obtained on the same cooling condition.

DETAILED DESCRIPTION OF PREFERRED EMBODIMENTS

First Exemplary Embodiment

Figure 1:
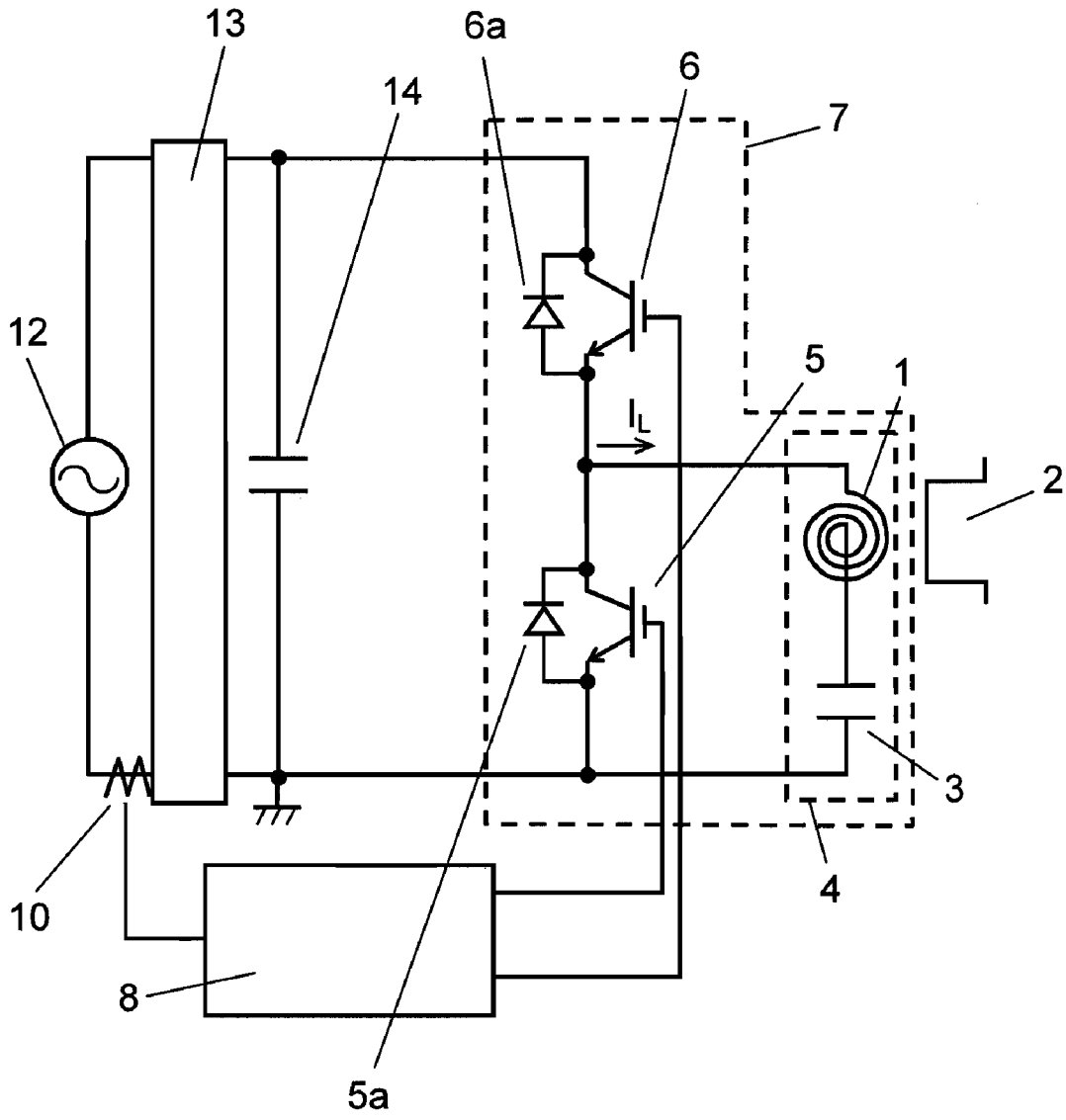
FIG. 1 is a circuit diagram of an induction heating cooking device in accordance with a first exemplary embodiment of the present invention.
Figure 2:
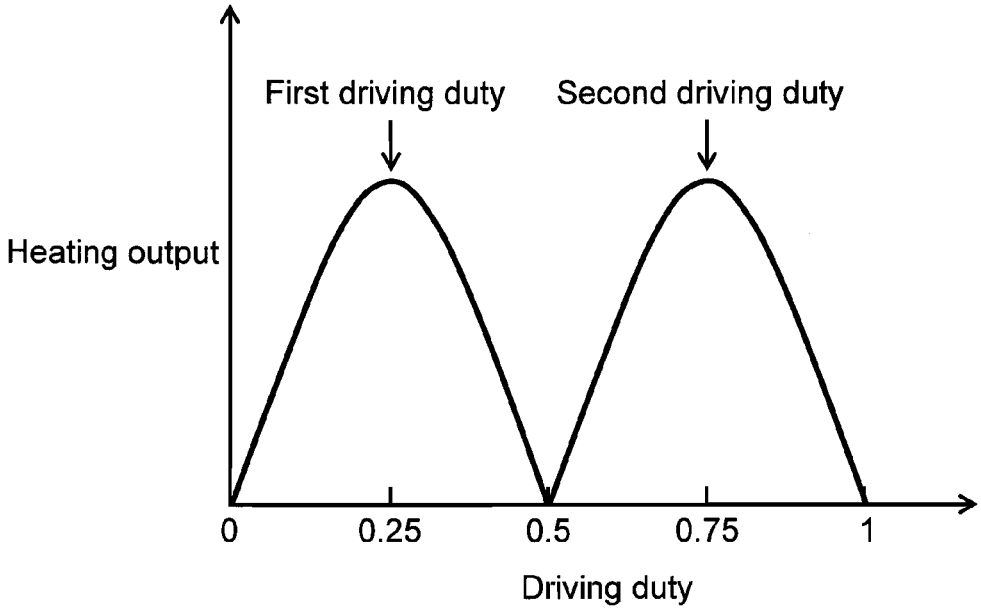
FIG. 2 is a characteristic diagram of a heating output of the induction heating cooking device shown in FIG. 1.
Figure 3:
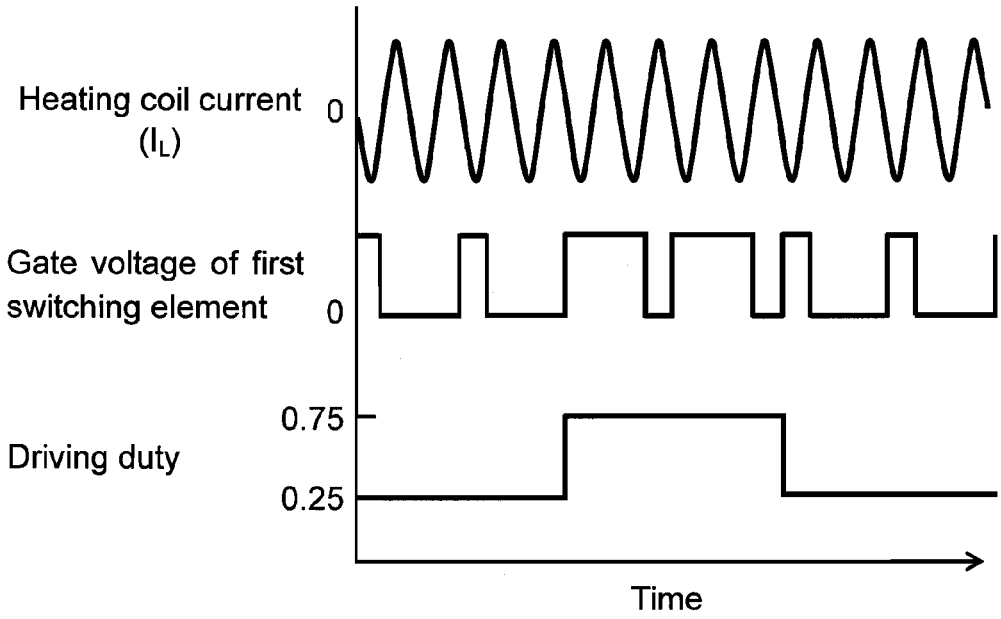
FIG. 3 is a characteristic diagram illustrating the driving duty of the induction heating cooking device shown in FIG. 1.

FIG. 1 is a circuit diagram of an induction heating cooking device in accordance with a first exemplary embodiment of the present invention. FIG. 2 is a characteristic diagram of a heating output of the induction heating cooking device shown in FIG. 1. FIG. 3 is a characteristic diagram illustrating the driving duty of the induction heating cooking device shown in FIG. 1.

In FIG. 1, power supply 12 is a 200V commercial power supply. The output of power supply 12 is converted to a high-frequency voltage by inverter 7, and a high-frequency magnetic field is generated in heating coil 1. Load 2 faces heating coil 1 that is magnetically coupled to load 2. Load 2 is a pan or the like. The material of a heated part of load 2 may at least partially include nonmagnetic metal with low resistivity such as aluminum or copper. Resonant Circuit 4 is constituted by resonant capacitor (hereinafter referred to as "capacitor") 3 connected to heating coil 1 in series.

Smoothing capacitor 14 and rectifying circuit 13 convert the current of power supply 12 to direct current. Here, rectifying circuit 13 is formed of a diode bridge and has a full-wave rectification function. Inverter 7 has a single end push-pull configuration. In this configuration, first switching element (hereinafter referred to as "element") 5 and second switching element (hereinafter referred to as "element") 6 are interconnected in series, and resonant circuit 4 connected to element 5 in parallel is used as an output part. Elements 5 and 6 are IGBTs, and are connected to first diode 5*a* and second diode 6*a*, in anti-parallel, respectively.

Heating output control part (hereinafter referred to as "control part") 8 drives element 5 and element 6 alternately. When the output of heating coil 1 is increased, control part 8 drives elements 5 and 6 so that the driving frequency of elements 5 and 6 approaches the resonance frequency of resonant circuit 4. Heating output detecting part (hereinafter referred to as "detecting part") 10 is formed of a current transformer and detects the heating output. For producing a predetermined heating output, control part 8 drives elements 5 and 6 while controlling the driving frequency of them based on the detection result of detecting part 10. Thus, control part 8 has at least a function of controlling the driving frequency of elements 5 and 6. This function facilitates the output control of inverter 7.

Heating coil 1 and capacitor 3 are set so that the resonance frequency of resonant circuit 4 is about 60 kHz. The driving frequency of elements 5 and 6 is set at about 30 kHz, namely half the resonance frequency of resonant circuit 4. In other words, heating coil 1 generates a high-frequency magnetic field using a secondary higher harmonic wave of the driving frequency of elements 5 and 6. This magnetic field reduces the driving frequency of elements 5 and 6 compared with the frequency of the current flowing in heating coil 1, thereby reducing the switching loss. Therefore, even nonmagnetic metal with low resistivity such as aluminum is efficiently heated.

As shown in FIG. 2, when respective rates of the driving period of element 5 and that of element 6 are defined as the driving duty, first driving duty is set at 0.25, and second driving duty is set at 0.75. The driving duty is set at the first driving duty or second driving duty, thereby obtaining the maximum heating output value when the driving duty is changed. The driving frequency of elements 5 and 6 is set at a frequency that is close to and higher than half the resonance frequency of resonant circuit 4. Therefore, while current flows in elements 5 and 6, elements 5 and 6 are cut off. As a result, before cut-off elements 5 and 6 are turned on, current flows in one of first diode 5*a* and second diode 6*a* that are connected to respective elements 5 and 6 in anti-parallel. Therefore, the zero voltage switching is performed. The turn-on loss of switching elements 5 and 6 is suppressed from increasing, so that the switching loss of elements 5 and 6 is reduced.

As shown in FIG. 3, the driving duty in starting the heating is set at the first driving duty, 0.25. After two cycles of driving is performed at the first driving duty, the driving duty is switched to the second driving duty, 0.75. After two cycles of driving is performed at the second driving duty, the driving duty is switched to the first driving duty 0.25, again.

When this switching operation is repeated, the average duty cycle of element 5 becomes equal to that of element 6. The on-state loss of element 5 therefore becomes equal to that of element 6. The switching frequency, voltage, and current of element 5 are equal to those of element 6, so that the switching loss of element 5 is also equal to that of element 6. Therefore, the total loss of element 5 is equal to that of element 6.

As discussed above, after the heating output is obtained at the first driving duty, substantially the same heating output is obtained at the second driving duty different from the first driving duty. In other words, after heating output is obtained at a certain driving duty, substantially the same heating output is obtained at a different driving duty. Thus, the driving duty defined by the rates of driving periods of element 5 and 6 is changed and controlled so that the driving periods of elements 5 and 6 are inverted in length and substantially the same heating output is obtained. The loss of element 5 thus becomes equal to that of element 6. When elements 5 and 6 are cooled on the same cooling condition by a cooling device (not shown) such as a cooling fan, elements 5 and 6 are cooled in a similar manner. As a result, a large heating output can be produced with a simple configuration.

The driving duty is switched on the condition where the loss of element 5 is substantially equal to that of element 6. Therefore, a similar advantage can be obtained even when the driving is not switched every two cycles.

The driving frequency of elements 5 and 6 is set close to ½ of the resonance frequency of resonant circuit 4 in the present embodiment. However, the driving frequency may be close to a value other than ½ thereof when the value is substantially 1/n (n is an integer of 2 or more) thereof. In other words, the driving frequency of elements 5 and 6 can be made lower than the current frequency of heating coil 1, so that the switching loss is reduced similarly.

Figure 4:
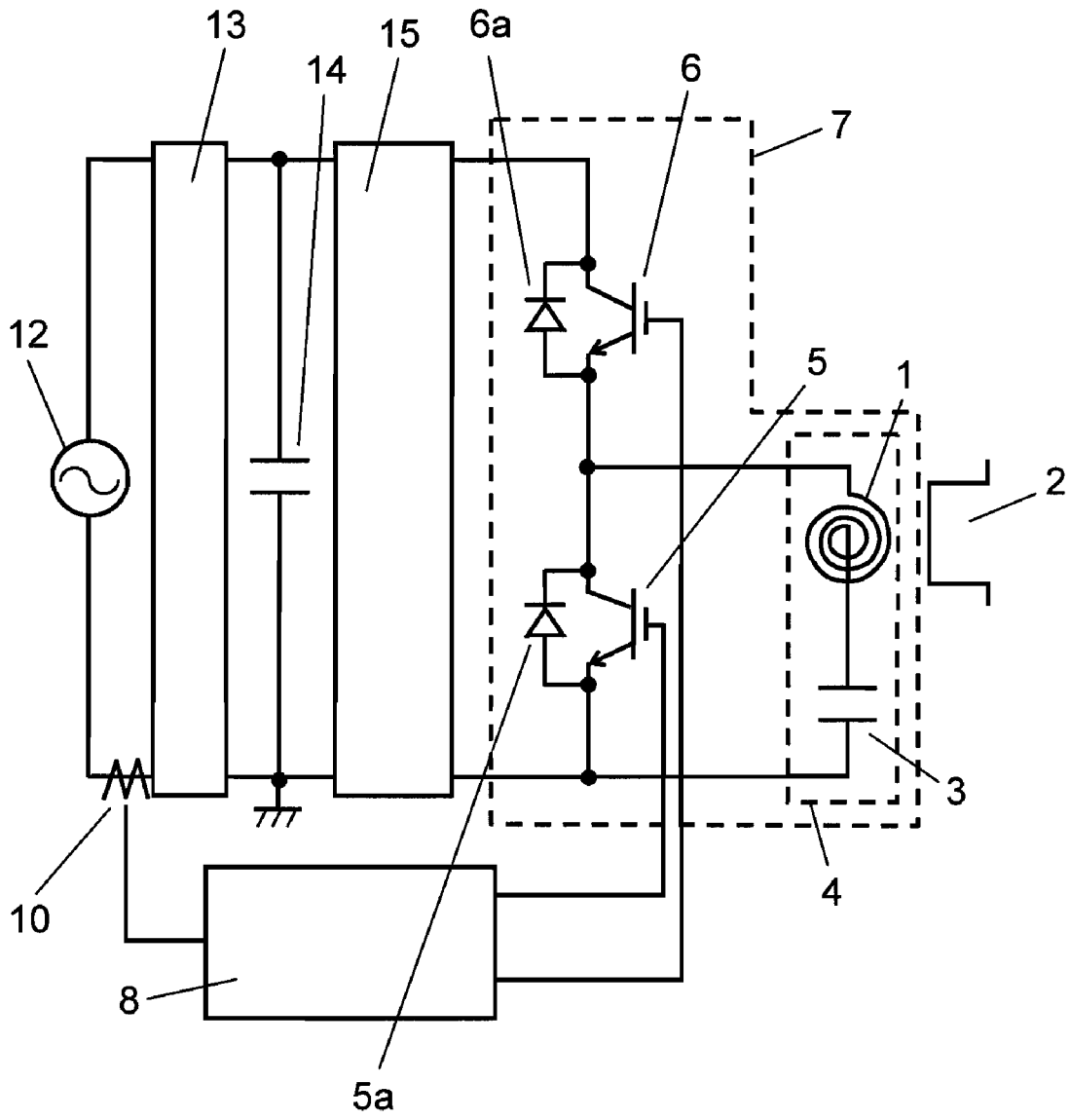
FIG. 4 is a circuit diagram of another example of the induction heating cooking device shown in FIG. 1.

Control part 8 controls the frequency in the present embodiment; however, control part 8 may control the input voltage to the inverter. For controlling the input voltage to the inverter, inverter input voltage control part 15 such as a voltage increasing chopper, a voltage decreasing chopper, or a voltage increasing/decreasing chopper is used as shown in FIG. 4. When switching between elements 5 and 6 can equalize the losses of elements 5 and 6, any control method can be used.

Resonant circuit 4 is a series resonance circuit in the present embodiment. However, even when resonant circuit 4 is a parallel resonance circuit and is driven by current control, an equivalent advantage is obtained. Resonant circuit 4 may be connected to element 6 in parallel.

Second Exemplary Embodiment

Figure 5:
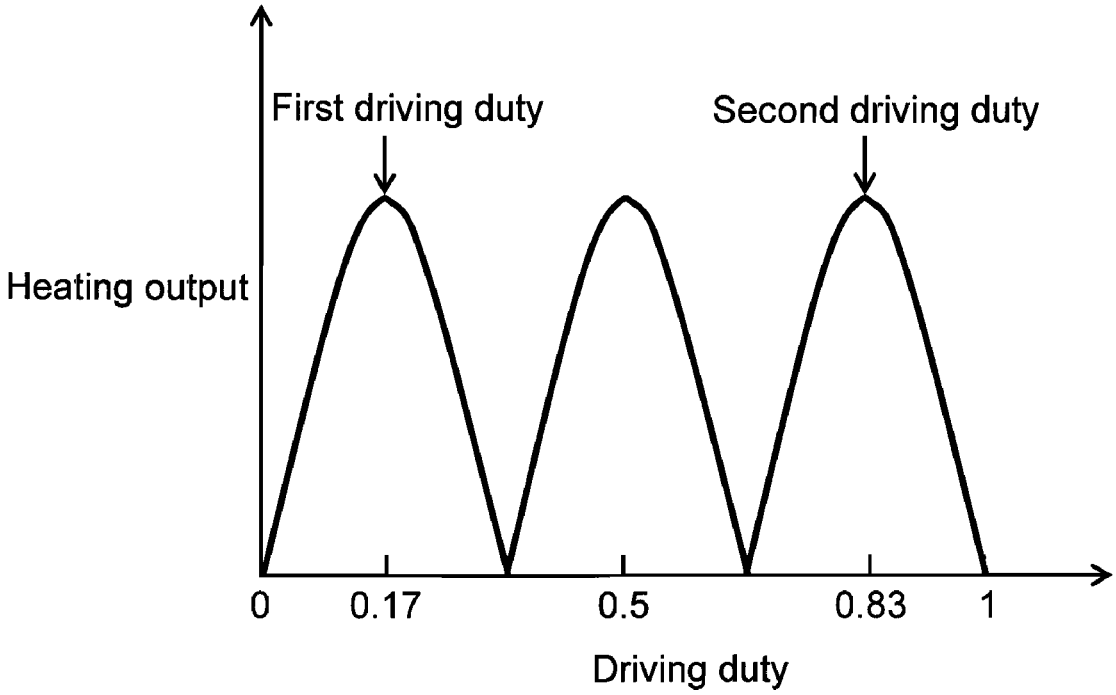
FIG. 5 is a characteristic diagram of a heating output of an induction heating cooking device in accordance with a second exemplary embodiment of the present invention.

FIG. 5 is a characteristic diagram showing a heating output characteristic of an induction heating cooking device in accordance with a second exemplary embodiment of the present invention. The basic configuration of the induction heating cooking device is the same as that of the induction heating cooking device of the first exemplary embodiment, so that different points are mainly described.

The second exemplary embodiment differs from the first exemplary embodiment in the following points. The driving frequency of switching elements 5 and 6 is set at about 20 kHz, namely ⅓ of the resonance frequency of resonant circuit 4, and the losses of elements 5 and 6 are further reduced. Different driving duty is substantially switched between $(2k-1)/2n$ (where, n is an integer of 2 or more, and k is any integer of 1 to n) and $1-((2k-1)/2n)$ (where, n is an integer of 2 or more, and k is any integer of 1 to n).

As shown in FIG. 5, the first driving duty is set at 0.17 ($=(2\times1-1)/(2\times3)$, n=3, k=1), and the second driving duty is set at 0.83 (=1−((2×1−1)/(2×3)), n=3, k=1). The sum of the first driving duty and the second driving duty is 1. Cooling conditions of elements 5 and 6 by the cooling device are different from each other. The period ratio of the first driving duty of 0.17 and the second driving duty of 0.83 are set according to the cooling conditions of elements 5 and 6. The losses of elements 5 and 6 are optimally distributed, respectively. Thus, when the respective cooling conditions are the same, heating control capable of producing a larger heating output is realized.

The case of n=3 has been described; however, the present invention is not limited to this condition, and an equivalent advantage can be obtained even when n is changed.

It has been assumed that k=1; however, the present invention is not limited to this condition, and k may be 2 or 3.

Third Exemplary Embodiment

Figure 6:
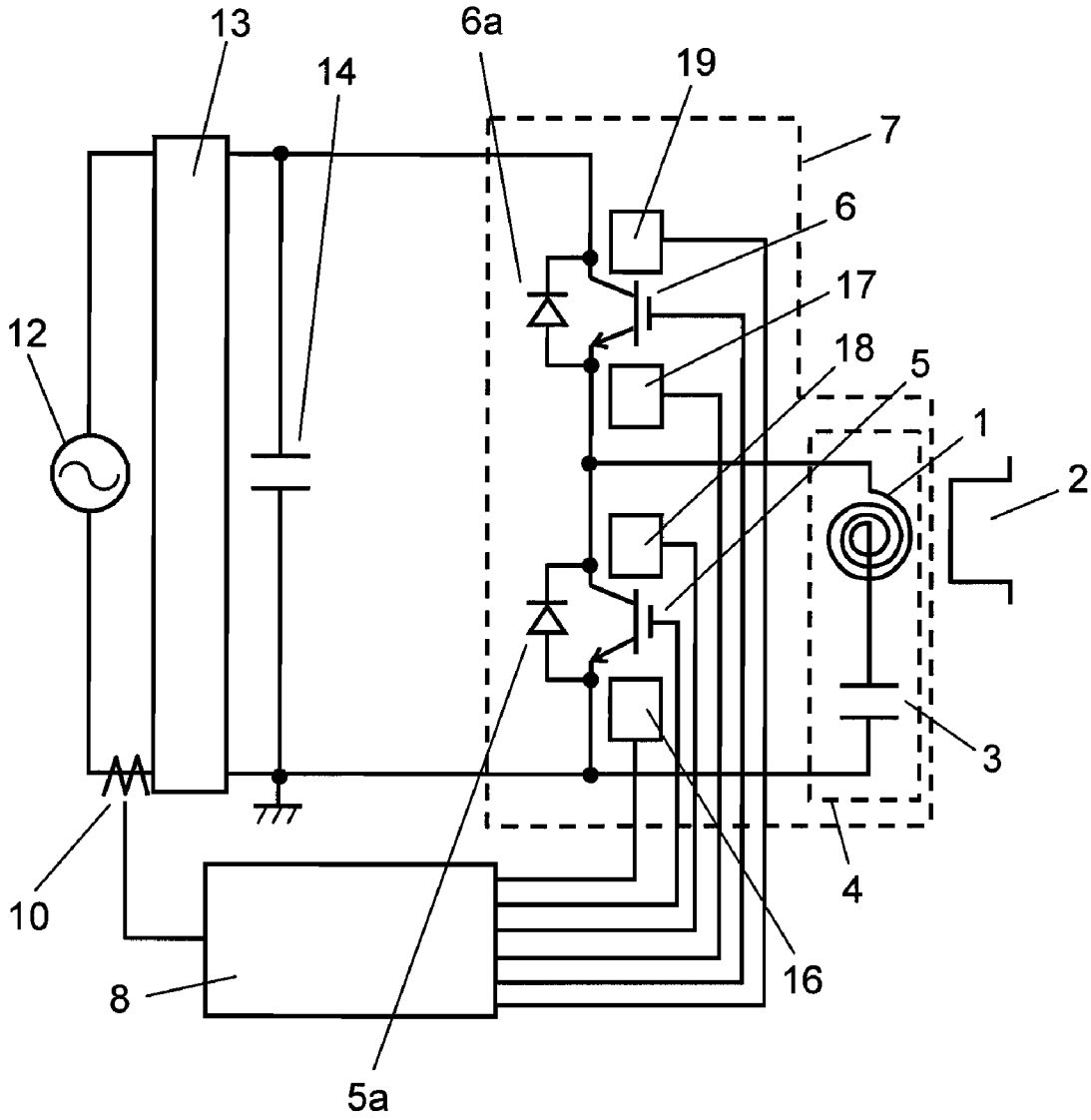
FIG. 6 is a circuit diagram of an induction heating cooking device in accordance with a third exemplary embodiment of the present invention.
Figure 7:
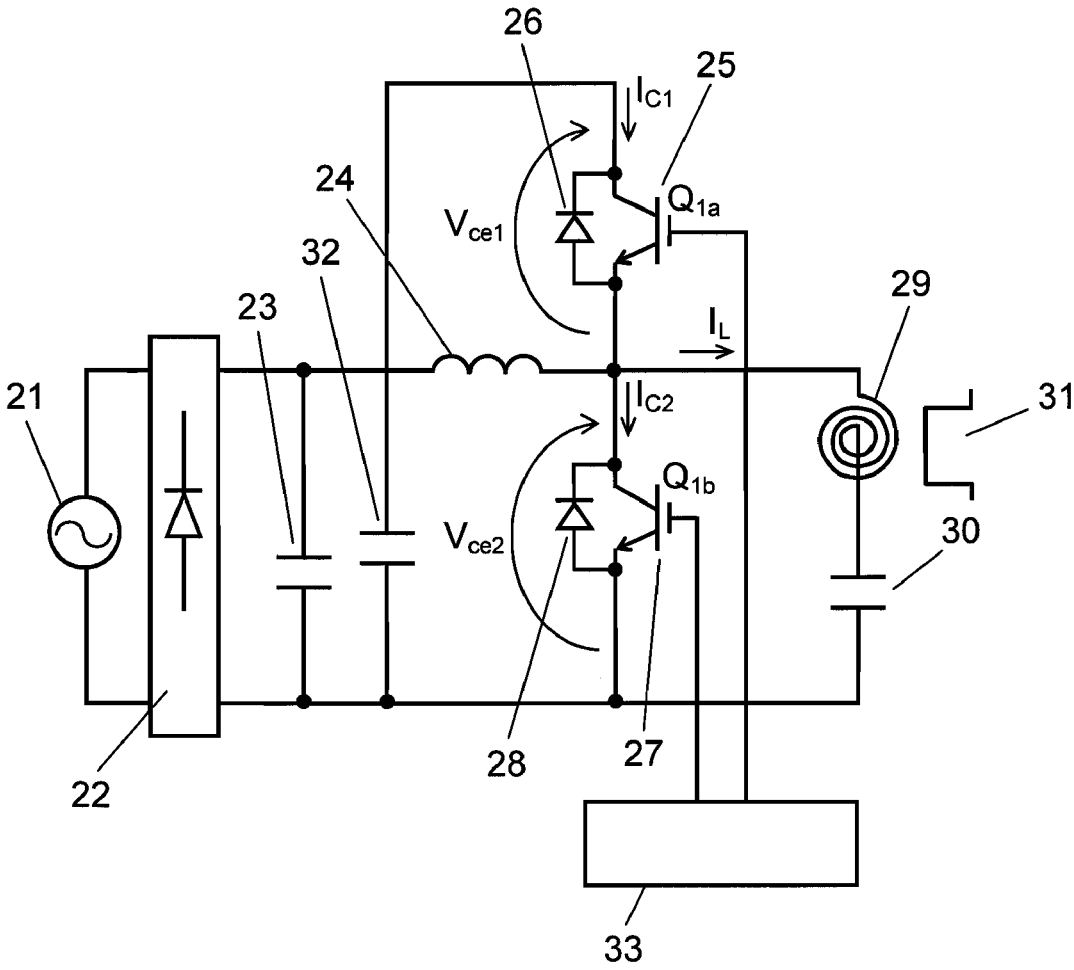
FIG. 7 (PRIOR ART)
FIG. 7 is a circuit diagram of a conventional induction heating cooking device.

FIG. 6 is a circuit diagram of an induction heating cooking device in accordance with a third exemplary embodiment of the present invention. The basic configuration of the induction heating cooking device is the same as that of the induction heating cooking device of the first exemplary embodiment, so that different points are mainly described Elements having a function similar to that in the first exemplary embodiment are denoted with the same reference marks, and the descriptions of those elements are omitted.

The third exemplary embodiment differs from the first exemplary embodiment as below. The induction heating cooking device of the third exemplary embodiment has the following elements:

first switching element temperature detecting part (hereinafter referred to as "detecting part") 16 for detecting the temperature of first switching element 5;

second switching element temperature detecting part (hereinafter referred to as "detecting part") 17 for detecting the temperature of second switching element 6;

first cooling part (hereinafter referred to as "cooling part") 18 for cooling element 5; and second cooling part (hereinafter referred to as "cooling part") 19 for cooling element 6.

Detecting parts 16 and 17 employ thermistors, and cooling parts 18 and 19 employ cooling fans.

The cooling conditions of elements 5 and 6 by cooling parts 18 and 19 are differently controlled by control part 8. There are upper limits on available temperatures of elements 5 and 6. The period ratio of the first driving duty of 0.25 and the second driving duty of 0.75 are set so that the temperatures of elements 5 and 6 are not higher than the upper limits on the available temperature thereof. In other words, when the temperature of element 5 is higher than that of element 6, the period ratio of the first driving duty of 0.25 is increased so as to reduce the loss of element 5. Contrariwise, when the temperature of element 6 is higher than that of element 5, the period ratio of the second driving duty of 0.75 is increased so as to reduce the loss of element 6. The losses of the switching elements are optimally distributed, respectively. Heating control capable of producing a larger heating output is realized.

The cooling conditions of cooling parts 18 and 19 can be changed. When the temperature of element 5 is higher than that of element 6, for example, the cooling condition of cooling part 18 is strengthened. Contrariwise, when the temperature of element 6 is higher than that of element 5, the cooling condition of cooling part 19 is strengthened. Thus, heating control capable of producing a larger heating output is realized.

Thermistors are used as detecting parts 16 and 17; however, even when another temperature detecting device such as a bimetal is used, an equivalent advantage is obtained.

Cooling fans are used as cooling parts 18 and 19 here. However, even when a Peltier element, a heat radiation member such as a cooling fin, or other cooling device is used, an equivalent advantage is obtained.

Cooling parts 18 and 19 for cooling elements 5 and 6 are individually disposed, but the number of cooling parts may be one. According to the material and shape of load 2, the loss of element 5 can be different from that of element 6. In this case, control part 8 changes and controls the driving duty while measuring the temperatures of elements 5 and 6 to average the losses of elements 5 and 6.

Control part 8 changes the driving duty of elements 5 and 6 while keeping the driving frequency of elements 5 and 6 constant, and produces a substantially constant heating output. However, the variation of the driving frequency of elements 5 and 6 may be added as appropriate for varying the heating output.

INDUSTRIAL APPLICABILITY

An induction heating cooking device of the present invention can thus produce a large heating output, so that the induction heating cooking device can be used for induction heating for household or industrial purposes.

The invention claimed is:

1. An induction heating cooking device comprising:

an inverter including a series circuit having a first switching element and a second switching element, the first switching element and the second switching element being connected to ends of a smoothing capacitor, a first diode connected to the first switching element in anti-parallel, a second diode connected to the second switching element in anti-parallel, and a resonant circuit having a heating coil and a resonant capacitor, the resonant circuit being connected to one of the first switching element and the second switching element in parallel; and a heating output control part that (i) alternately drives the first switching element and the second switching element, and (ii) controls a heating output used when the heating coil induction-heats a load;

wherein the heating output control part sets a driving frequency of the first switching element and the second switching element to be substantially 1/n (where, n is an integer of 2 or more) times higher than a resonance frequency of the resonant circuit when heating the load, wherein the heating output control part (i) repeatedly switches a driving duty, which is defined by rates of a driving period of the first switching element and a driving period of the second switching element, between a first driving duty and a second driving duty different from the first driving duty, and (ii) controls the driving duty so that temperatures of the first switching element and the second switching element are at or below a reference temperature, and wherein the second driving duty is a driving duty at which (i) the driving period of the first switching element and the driving period of the second switching element are inverted in length with respect to the first driving duty, and (ii) a substantially same heating coil current and heating output are obtained before and after the switching between the first and second driving duties by alternately driving the first switching element and the second switching element during the second driving duty in an order that is the same as an order of alternatively driving the first switching element and the second switching element during the first driving duty while the driving frequency is constant.

2. The induction heating cooking device according to claim 1, wherein the heating output control part controls the driving duty so that (i) the driving period of the first switching element and the driving period of the second switching element are inverted in length and (ii) a substantially same heating output is obtained by switching the driving duty from substantially $(2k-1)/2n$ (where, k is any integer of 1 to n) to substantially $1-((2k-1)/2n)$ (where, k is any integer of 1 to n).

3. The induction heating cooking device according to claim 1, wherein the heating output control part controls the heating output of the heating coil by controlling the driving frequency of the first switching element or the second switching element.

4. The induction heating cooking device according to claim 1, wherein the heating output control part controls the heating output of the heating coil by controlling voltage fed into the inverter.

5. The induction heating cooking device according to claim 1, wherein the load is made of nonmagnetic metal with low resistivity.

* * * * *